US005564692A

United States Patent [19]

Lötsch et al.

[11] Patent Number: 5,564,692

[45] Date of Patent: Oct. 15, 1996

[54] DEVICE FOR SMEAR-FREE SHEET TRANSPORT IN AN OFFSET PRINTING PRESS

[75] Inventors: Kurt Lötsch, Wiesenbach; Bernd Ruf, Weiterstadt, both of Germany

[73] Assignee: Heidelberger Druckmaschinen AG, Heidelberg, Germany

[21] Appl. No.: 312,319

[22] Filed: Sep. 26, 1994

[30] Foreign Application Priority Data

Sep. 25, 1993 [DE] Germany ..... 43 32 708.7

[51] Int. Cl.[6] ..... B65H 29/24

[52] U.S. Cl. ..... 271/195; 101/420

[58] Field of Search ..... 271/195, 82, 276, 271/277; 101/420

[56] References Cited

U.S. PATENT DOCUMENTS 4,466,605 8/1984 Leuthold et al. ..... 271/195 X
4,688,784 8/1987 Wirz ..... 271/195

FOREIGN PATENT DOCUMENTS 0017776 10/1980 European Pat. Off. .
1176672 4/1965 Germany .
2720871 2/1984 Germany .

OTHER PUBLICATIONS

R. P. Auyang, Pneumatic Drum, May 1961, IBM Technical Disclosure Bulletin vol. 3 No. 12 p. 6.

*Primary Examiner*—William E. Terrell
*Assistant Examiner*—Tamara Kelly
*Attorney, Agent, or Firm*—Herbert L. Lerner; Laurence A. Greenberg

[57] ABSTRACT

Device for smear-free transport of sheets having fresh printing ink thereon on a revolvingly driven cylinder in a sheet-fed printing press includes air outlet openings for pressurized air provided on the circumference of the revolvingly driven cylinder in a sheet-bearing region thereof for bearing the sheet to be transported, and a fixed covering for closing the air outlet openings on the inside of the revolvingly driven cylinder prior to a takeover of the sheet to be transported by the revolvingly driven cylinder.

3 Claims, 3 Drawing Sheets

DEVICE FOR SMEAR-FREE SHEET TRANSPORT IN AN OFFSET PRINTING PRESS

SPECIFICATION

The invention relates to a device for smear-free transport of sheets with fresh printing ink on the jacket surface of a revolvingly driven cylinder in an offset printing press.

To improve the ink dispensing performance in an offset sheet-fed printing press for recto/verso printing, it has been known heretofore to provide the jacket surface of the printing cylinder with a covering in the form of a foil or a sheet-metal jacket (published European Patent Document EP 0 017 776 B1). However, the cylinder carrying the freshly printed sheet onward touches the sheet as it is being transferred, so that the fresh printing ink comes into contact with the cylinder jacket, and the danger arises that the fresh printing ink will smear. Attempts have been made to counteract this danger of smearing by providing a covering of sheet metal or foil on the jacket of the transfer cylinder, but this makes for an unfavorable relationship between the necessary expense and the effect to be achieved. Pin disks or pin wheels in the cylinder transporting a sheet having fresh printing ink thereon have also become known heretofore, the sheet being carried on the tips of the pins, but these arrangements have been equally unsuccessful until now, above all in high-speed printing presses.

Transporting sheets in a printing press on a cushion of air formed by air emerging from a number of nozzles has also become known per se, for example, from German Patent 1 176 672 and other publications.

It is accordingly an object of the invention to provide an economical device, which is effective even at high printing speeds, for smear-free transport of a sheet with fresh printing in an offset sheet-fed printing press.

With the foregoing and other objects in view, there is provided, in accordance with the invention, a device for smear-free transport of sheets having fresh printing ink thereon on a revolvingly driven cylinder in a sheet-fed printing press, comprising means defining air outlet openings for pressurized air provided on the circumference of the revolvingly driven cylinder in a sheet-bearing region thereof for bearing the sheet to be transported, and a fixed covering for closing the air outlet openings on the inside of the revolvingly driven cylinder prior to a takeover of the sheet to be transported by the revolvingly driven cylinder.

In accordance with another feature of the invention, the air outlet openings are formed in a jacket of the revolvingly driven cylinder and are disposed in succession in a row extending in the circumferential direction of the revolvingly driven cylinder, and the covering comprises a disk segment having a jacket surface covering the air outlet openings on the inside of the cylinder jacket.

In accordance with a further feature of the invention, the disk segment is disposed in fixed position inside the revolvingly driven cylinder so as to cover the air outlet openings prior to an instant at which the revolvingly driven cylinder reaches a sheet transfer point at which the sheet is taken over by the revolvingly driven cylinder, the disk segment being formed as a double-walled structure in a region following the sheet transfer point, the double-walled structure defining a chamber communicating with an air supply to the revolvingly driven cylinder, the chamber being open at the circumference thereof.

In accordance with an added feature of the invention, the device includes a jacket segment adjustable in circumferential direction of the revolvingly driven cylinder for closing, on the outside of the revolvingly driven cylinder, a trailing end of the row of air outlet openings, as viewed in sheet travel direction.

In accordance with an additional feature of the invention, the air outlet openings are disposed in a plurality of mutually spaced-apart rows in the circumferential direction of the revolvingly driven cylinder, and a respective disk segment is provided in vicinity of each of the rows of air outlet openings, the respective chamber defined by the respective double-walled structure of the respective disk segment being connected in blockable manner to the air supply.

In accordance with a concomitant feature of the invention, the device includes a fixed shaft whereon the respective disks are mounted in axially adjustable relationship to one another, the shaft being formed with an air conduit for providing the air supply.

The disposition of the air outlet openings is made in the region covered by the sheet on the cylinder that transports the sheet. Advantageously, however, the disposition of air outlet openings is in the circumferential direction in one row or in a plurality of rows of the cylinder, and the covering of each row comprises a disk segment having a jacket surface which covers the air outlet openings on the inside of the cylinder jacket. Such an arrangement permits regulation of the blowing air emerging from the openings of one row and also permits easier adaptation to different formats, so that for smaller formats, outer rows of air outlet openings can be more easily blocked off from the air which is supplied.

As noted, In a further concept of the invention, in the cylinder, one disk for each row of air outlet openings is disposed in a fixed manner, on the one hand, covering the air outlet openings of the revolvingly driven cylinder prior to the attainment of the sheet transfer point and, on the other hand, having a double-walled structure in the region behind or after the sheet transfer point, so that a chamber which is open at the circumference of the disk and is connectable to the air supply is created. In this way, the outflow of blowing air in the region of the cylinder jacket surface covered by the sheet to be transported can be achieved by relatively simple means, and an escape of air in the region of the cylinder jacket surface not covered by the sheet can be prevented. To that end, in a further feature of the invention it is provided that the rear or trailing end of the air outlet openings, in terms of the sheet travel direction, is closeable on the outside of the cylinder by means of a jacket segment which is adjustable in the circumferential direction of the cylinder. This jacket segment revolves with the cylinder and, in the case of smaller formats, can be adjusted as far as the trailing edge of the sheet, so that an escape of air is averted in the region behind the sheet to be transported.

Especially with larger sheet formats, air outlet openings are advantageously spaced apart in a plurality of rows, and one disk is provided in the region of each row, the air chamber of the respective disk being connected in blockable fashion to the air supply. As a result, with smaller sheet formats, the outer row of air outlet openings can be blocked off, in order to avert a free outflow of air without backup pressure. An axially displaceable arrangement of disks on a fixed shaft which has a conduit for air delivery is also possible, so that the disks for smaller formats are displaced axially far enough that the open side of the air chamber is covered by the closed jacket of the cylinder.

Other features which are considered as characteristic for the invention are set forth in the appended claims.

Although the invention is illustrated and described herein as embodied in a device for smear-free sheet transport in an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
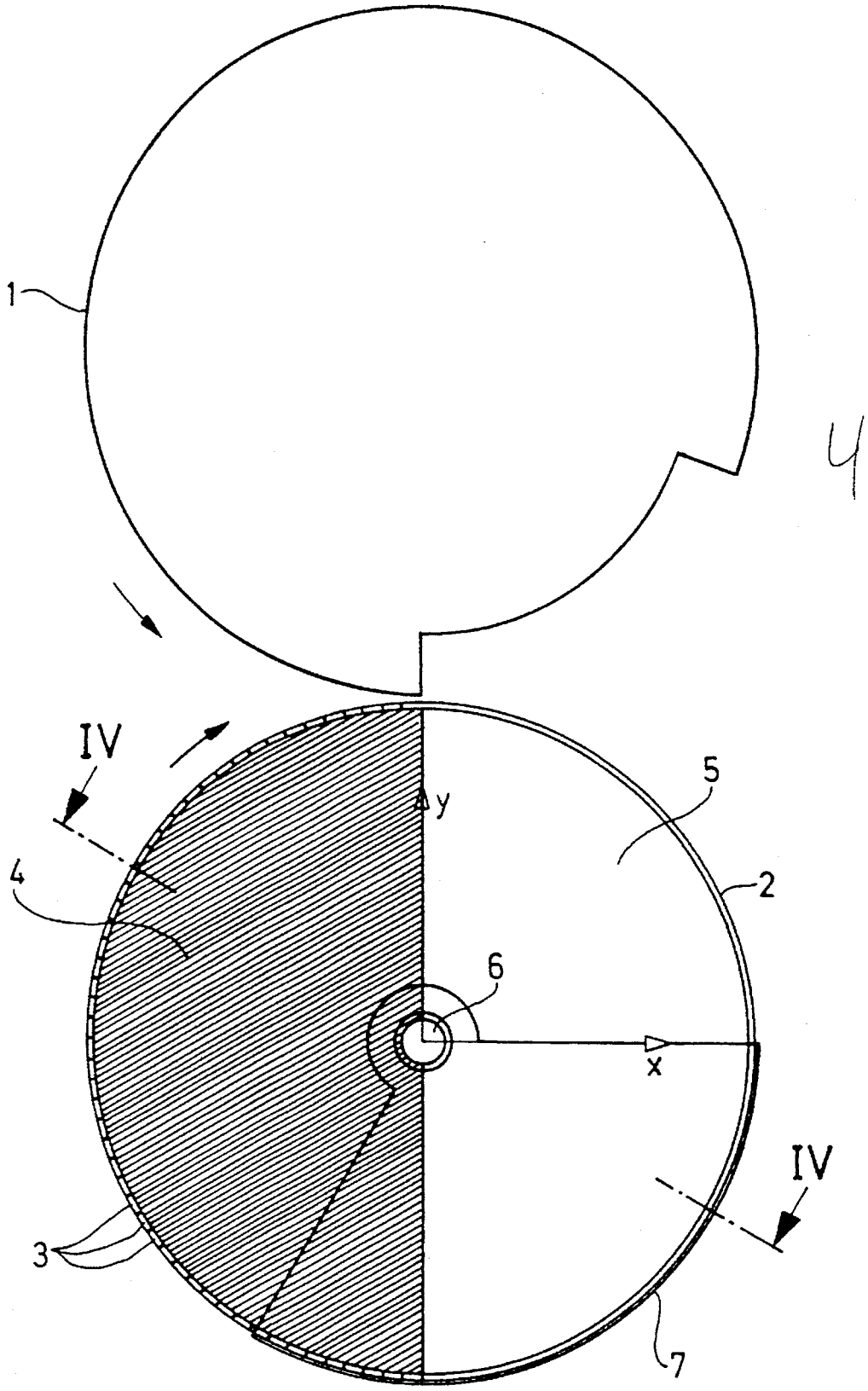
FIG. 1 is a diagrammatic side elevational view of an impression and a transfer cylinder in a position at the instant a sheet is accepted or taken over from the impression cylinder by the transfer cylinder.

The features of the invention are shown in the drawings by way of example for a transfer cylinder in conjunction with an impression cylinder of an offset sheet-fed printing press.

Figure 2:
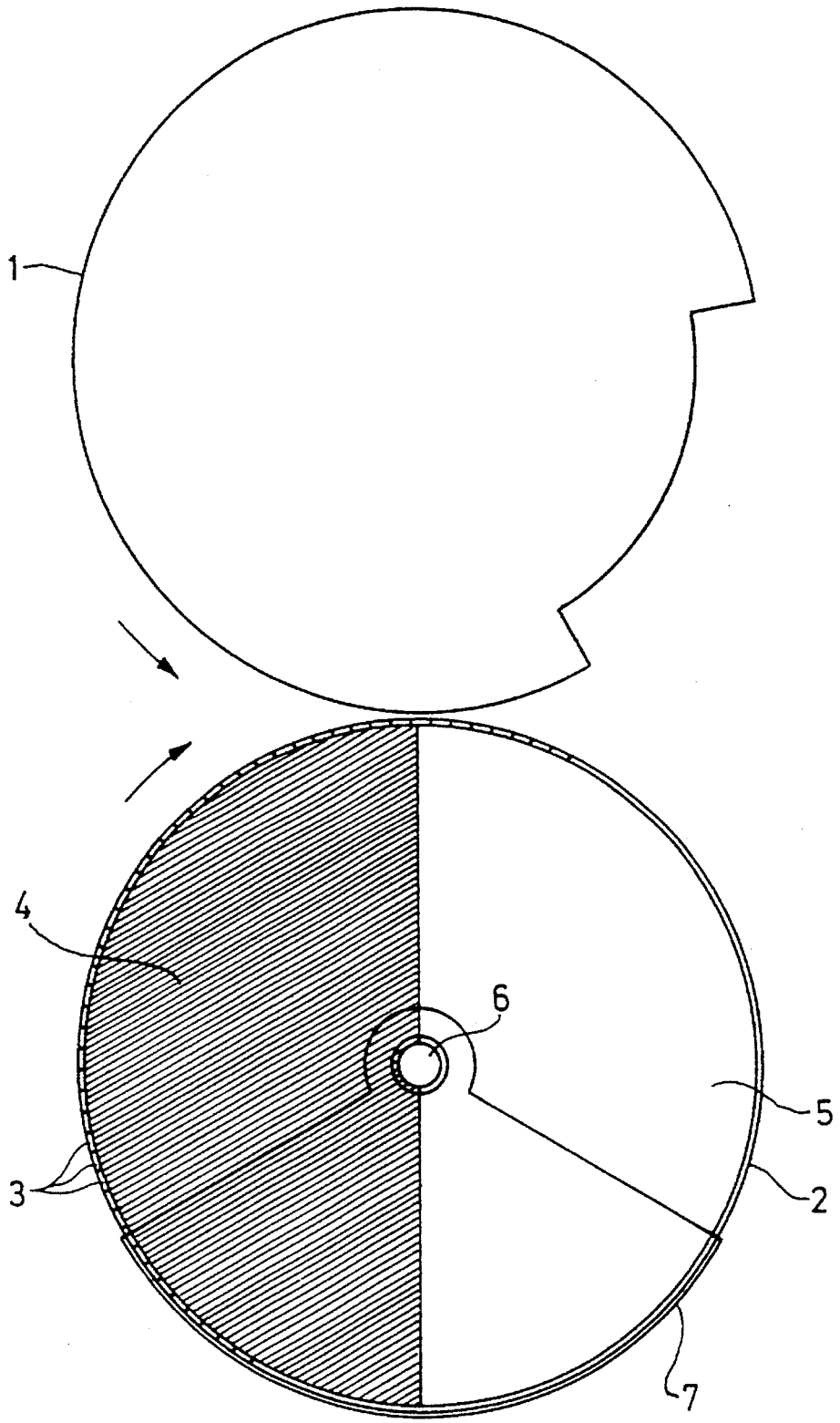
FIG. 2 is a view of the positions of the cylinders of FIG. 1 in another operating phase thereof after sheet acceptance or takeover by the transfer cylinder.
Figure 3:
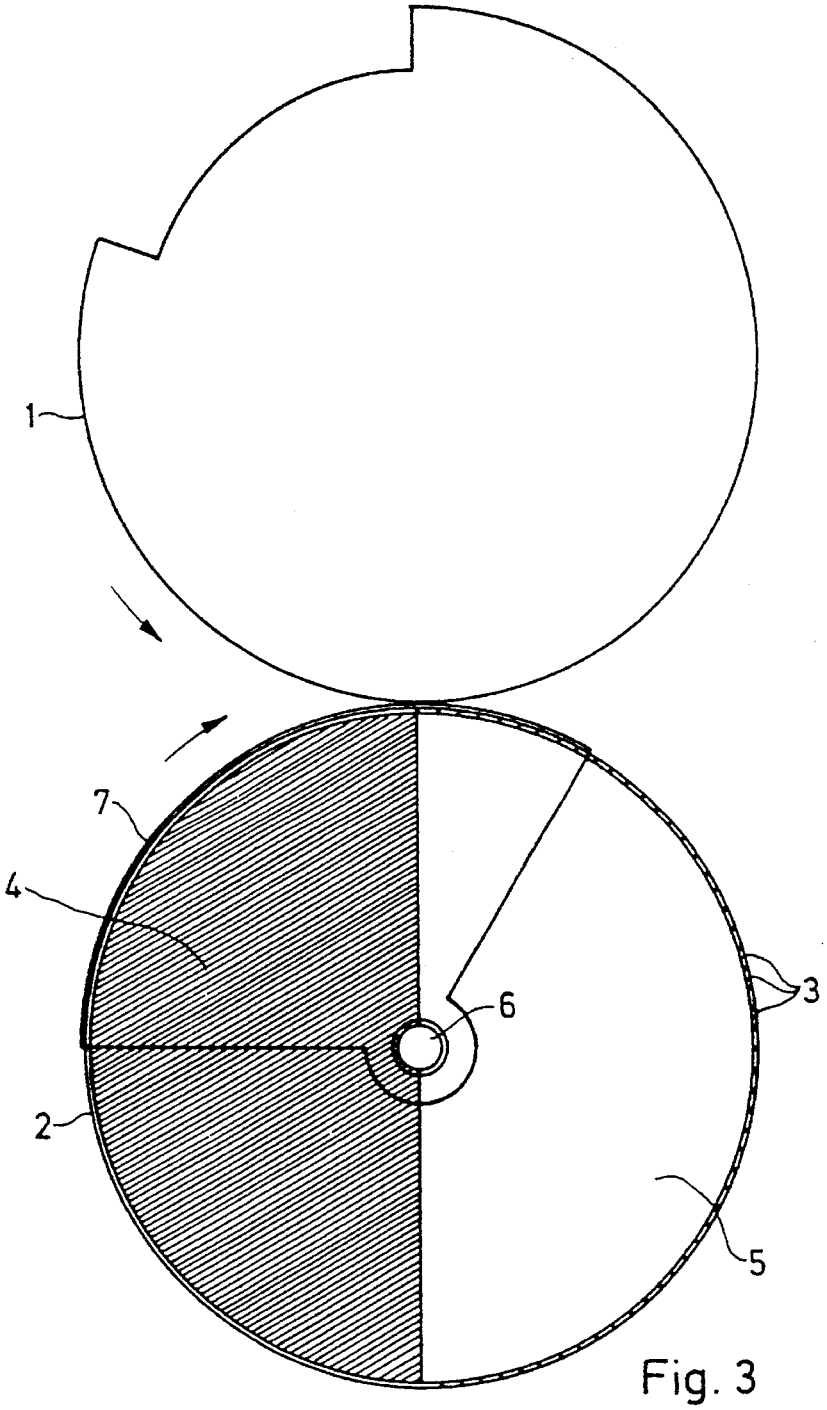
FIG. 3 is a further view of the positions of the cylinders in yet another operating phase thereof at the end of sheet acceptance or takeover by the transfer cylinder.
Figure 4:
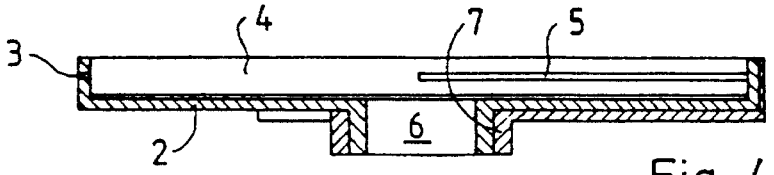
FIG. 4 is a cross-sectional view of FIG. 1 taken along the line IV—IV in the direction of the arrows.

Referring now specifically to the figures of the drawings, there is shown in FIGS. 1, 2 and 3, an impression cylinder 1 of an offset sheet-fed printing press below which a transfer cylinder 2 is disposed, which accepts or takes over a freshly printed sheet and transports it to a further printing unit, for example. In the interest of simplicity, the gripper systems of the printing cylinder 1 and the transfer cylinder 2 are not shown in the drawings. The gripper system of the transfer cylinder 2 grips the leading edge of the sheet at the transfer point, so that the sheet comes to rest against the circumference of the transfer cylinder 2. To avert contact of the yet fresh printing ink with the jacket surface of the transfer cylinder 2, the sheet is supposed to be supported on a cushion of air. To attain this goal, air outlet openings 3 are provided, close together, in the jacket adjoining the gripper system of the transfer cylinder 2, in a region corresponding to the maximum sheet length. The disposition of these air outlet openings is preferably made in parallel rows, over an angular range extending over approximately 180° of a double-size transfer cylinder. Inside the transfer cylinder 2, in the region of the air outlet openings 3 which are disposed in rows, fixed disks 4 are provided having a circumferential surface which, over a correspondingly large segment, covers the air outlet openings 3 on the inside. The other half of each of the fixed disks 4 is a double-walled structure, so that one air chamber 5 open at its circumference is formed between each two side walls. The slitlike open side of this air chamber 5 is located in the same plane as a row of the air outlet openings 3, transversely to the axis of the transfer cylinder 2. Through a conduit 6 in the shaft of the transfer cylinder 2, the air chamber 5 communicates with the compressed air system of the printing press. A plurality of rows of air outlet openings 3 and correspondingly complementary disks 4 are disposed side by side in the aforedescribed embodiment of the invention. As shown even more clearly in FIG. 4, also located on the outside of the jacket of the transfer cylinder 2 is an adjustable jacket segment 7, which revolves with the transfer cylinder 2 but is adjustable relative to it.

At the instant of time the sheet is engaged by the gripper system of the transfer cylinder 2 at the transverse point, all the air outlet openings 3 are closed by the fixed disks 4. Only thereafter do the air outlet openings 3 reach the slit region of the disks 4, so that they are acted upon by compressed air via the conduit 6 and the air chamber 5. The air outlet openings 3 are thus covered by the sheet wrapping around the transfer cylinder 2, so that the resultant backup pressure protects the sheet against any contact with the jacket surface of the transfer cylinder 2. The air outlet openings are thus covered either by the disk region of solid material on the inside or by the sheet on the outside, so that no air can flow out freely, and a drop in the pressure of the entire system is prevented. For short sheet lengths, the leading edge of the jacket segment 7 is adjusted relative to the jacket of the transfer cylinder 2 in such a way that it coincides with the trailing edge of the shorter sheet. With shorter sheets, the jacket segment 7 thus prevents the escape of air through the air outlet openings 3 until these openings have again been closed completely on the inside by the disk 4. For adaptation to various sheet widths, the air outlet openings or the air conduits for the air delivery to these air outlet openings can be shut off individually at both ends of the transfer cylinder 2. To that end, the disks 4 on the shaft of the transfer cylinder 2 which has the conduit 6 can be disposed laterally displaceably, so that, during rotation of the transfer cylinder 2, no communication between the air outlet openings 3 and the air chambers 5 takes place.

The foregoing is a description corresponding in substance to German Application P 43 32 708.7, dated Sep. 25, 1993, the International priority of which is being claimed for the instant application, and which is hereby made part of this application. Any material discrepancies between the foregoing specification and the aforementioned corresponding German application are to be resolved in favor of the latter.

We claim:

1. Device for smear-free transport of sheets having fresh printing ink thereon on a revolvingly driven cylinder in a sheet-fed printing press, comprising means defining air outlet openings for pressurized air provided on the circumference of the revolvingly driven cylinder in a sheet-bearing region thereof for bearing the sheet to be transported, said air outlet openings are formed in a jacket of the revolvingly driven cylinder and are disposed in succession in a row extending in the circumferential direction of the revolvingly driven cylinder, and a fixed covering for closing said air outlet openings on the inside of the revolvingly driven cylinder prior to a takeover of the sheet to be transported by the revolvingly driven cylinder, said covering comprising a disk segment having a jacket surface covering said air outlet openings on the inside of said cylinder jacket, said disk segment being disposed in fixed position inside the revolvingly driven cylinder so as to cover said air outlet openings prior to an instant at which the revolvingly driven cylinder reaches a sheet transfer point at which the sheet is taken over by the revolvingly driven cylinder, said disk segment being formed as a double-walled structure in a region following said sheet transfer point, said double-walled structure defining a chamber communicating with an air supply to the revolvingly driven cylinder, said chamber being open at the circumference thereof; and a jacket segment adjustable in circumferential direction of the revolvingly driven cylinder for closing, on the outside of the revolvingly driven cylinder, a trailing end of said row of air outlet openings, as viewed in sheet travel direction.

2. Device for smear-free transport of sheets having fresh printing ink thereon on a revolvingly driven cylinder in a sheet-fed printing press, comprising means defining air outlet openings for pressurized air provided on the circumference of the revolvingly driven cylinder in a sheet-bearing region thereof for bearing the sheet to be transported, said air outlet openings are formed in a jacket of the revolvingly driven cylinder and are disposed in succession in a row extending in the circumferential direction of the revolvingly driven cylinder, and a fixed covering for closing said air outlet openings on the inside of the revolvingly driven cylinder prior to a takeover of the sheet to be transported by the revolvingly driven cylinder, said covering comprising a disk segment having jacket surface covering said air outlet opening on the inside of said cylinder jacket, said disk segment being disposed in fixed position inside the revolvingly driven cylinder so as to cover said air outlet openings prior to an instant at which the revolvingby driven cylinder reaches a sheet transfer point at which the sheet is taken over by the revolvingly driven cylinder, said disk segment being formed as a double-walled structure in a region following said sheet transfer point, said double-walled structure defining a chamber communicating with an air supply to the revolvingly driven cylinder, said chamber being open at the circumference thereof; and wherein said air outlet openings are disposed in a plurality of mutually spaced-apart rows in the circumferential direction of the revolvingly driven cylinder, and a respective disk segment is provided in vicinity of each of said rows of air outlet openings, the respective chamber defined by the respective double-walled structure of the respective disk segment being connected in blockable manner to the air supply.

3. Device according to claim 2, including a fixed shaft whereon the respective disks are mounted in axially adjustable relationship to one another, said shaft being formed with an air conduit for providing said air supply.

* * * * *